US007285738B2

(12) United States Patent
Lavigne et al.

(10) Patent No.: US 7,285,738 B2
(45) Date of Patent: Oct. 23, 2007

(54) CONTROL KNOB AND CONTROL PANEL

(75) Inventors: Kim Cyril Lavigne, Baroda, MI (US); Phillip Henry DeRuiter, Bangor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/354,743

(22) Filed: Feb. 15, 2006

(65) Prior Publication Data

US 2007/0187215 A1 Aug. 16, 2007

(51) Int. Cl.
*H01H 9/00* (2006.01)

(52) U.S. Cl. ..... 200/4; 200/18

(58) Field of Classification Search ..... 200/336, 200/566, 4, 18

See application file for complete search history.

(56) References Cited

U.S. PATENT DOCUMENTS

| | | | | |
|---|---|---|---|---|
| 2,797,592 | A | 7/1957 | Marrapese | 74/548 |
| 2,899,841 | A | 8/1959 | Melloy | 74/548 |
| 4,037,490 | A | 7/1977 | Wilson | 74/553 |
| 5,384,442 | A | 1/1995 | Danner | 200/566 |
| 5,771,878 | A | 6/1998 | Lewis et al. | 126/42 |
| 6,394,081 | B1 | 5/2002 | Aguirre-Esponda et al. | 126/42 |
| 2005/0034967 | A1 | 2/2005 | Huber | 200/566 |
| 2005/0284737 | A1* | 12/2005 | Shitanaka et al. | 200/5 R |
| 2006/0081451 | A1* | 4/2006 | Masuda et al. | 200/341 |
| 2006/0102457 | A1* | 5/2006 | Chen et al. | 200/345 |

* cited by examiner

*Primary Examiner*—Elvin Enad
*Assistant Examiner*—Lisa Klaus
(74) *Attorney, Agent, or Firm*—Michael D. Lafrenz; John Morrison

(57) ABSTRACT

A control knob for a control panel assembly having a panel to which a push-and-turn switch assembly is mounted, with the switch assembly having a stem axially movable and rotatable to effect actuation of the switch assembly. The control knob has a cap and a skirt. The cap is axially immobile relative to the stem, and the skirt is coupled with the stem for axial movement therewith. The skirt is axially moveable relative to the cap. An axial force acting on the cap is not transferred to the stem and an axial force acting on the skirt will cause axial movement of the stem.

16 Claims, 6 Drawing Sheets

CONTROL KNOB AND CONTROL PANEL

BACKGROUND OF THE INVENTION

1. Field of the Invention

The invention relates generally to a control knob for an appliance such as a stove.

2. Description of the Related Art

Control knobs are ubiquitous for appliances such as stoves which use a rotational control device to control energy delivery to a heating element. Such a control device has a stem portion connected to a valve, a rheostat, or a similar component, which can be rotated to selectively control the delivery of gas or electricity to the heating element. On the control device is frequently provided with a safety mechanism that prevents rotation of the stem portion unless the stem portion has first been depressed. Such devices are frequently referred to as "push and turn" control devices, and are in common use in the home appliance industry.

While such devices require both a pushing and a rotating action to operate the device, which prevents inadvertent rotation of the knob by, for example, small children, the knob can still be inadvertently depressed and rotated by a person bumping up against the appliance, or leaning over the appliance to reach something stored above the appliance.

There is a need for a control knob that resists inadvertent depression of a push and turn control device but which can be effectively utilized in activating a conventional push and turn control device.

SUMMARY OF THE INVENTION

A control knob for a control panel assembly having a panel to which a push-and-turn switch assembly is mounted, with the switch assembly having a stem axially movable and rotatable to effect actuation of the switch assembly. The control knob has a cap and a skirt. The cap is axially immobile relative to the stem, and the skirt is coupled with the stem for axial movement therewith. The skirt is axially moveable relative to the cap. With this configuration, an axial force acting on the cap is not transferred to the stem and an axial force acting on the skirt will cause axial movement of the stem.

DESCRIPTION OF AN EMBODIMENT OF THE INVENTION

Figure 1:
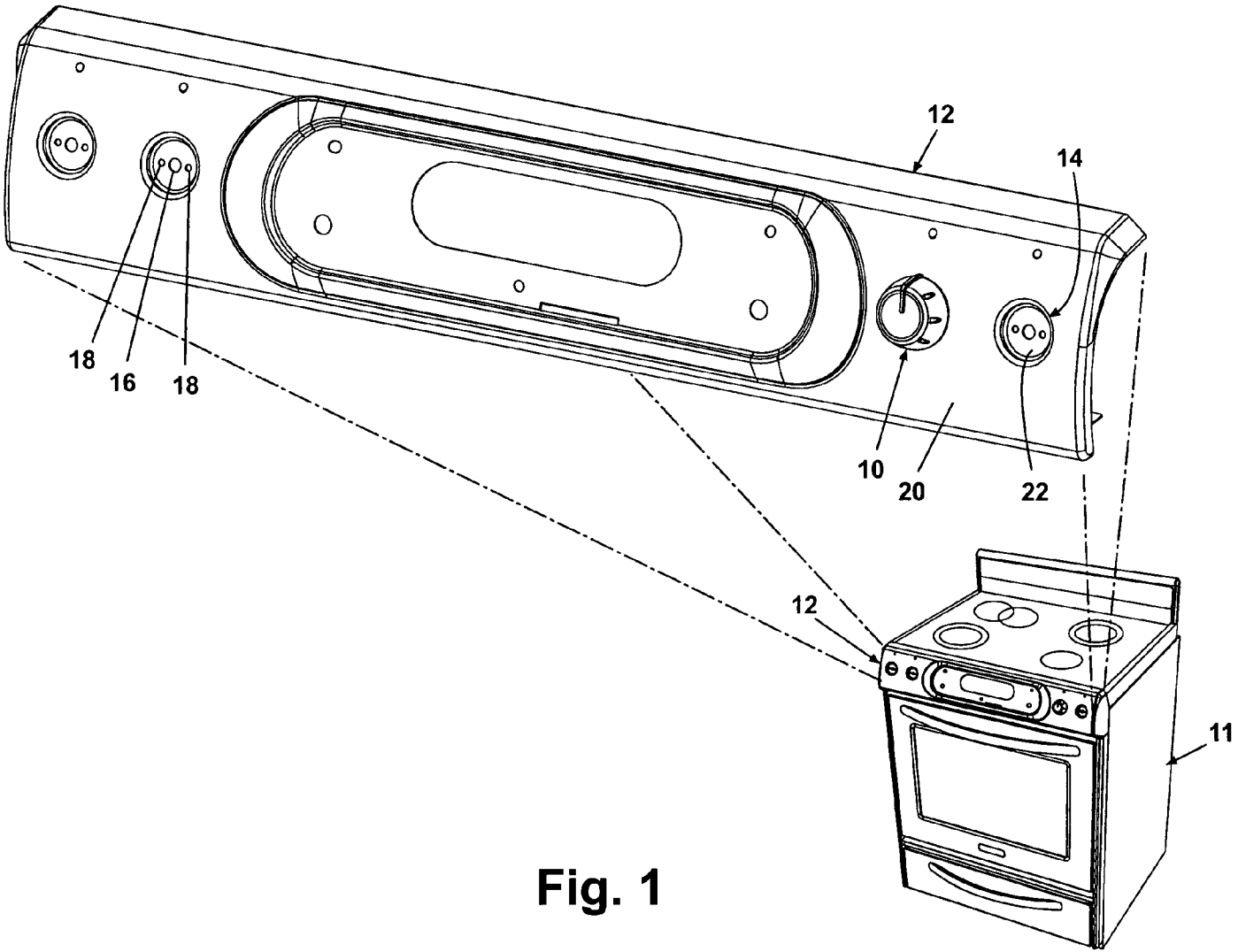
FIG. 1 is a perspective view of a portion of a control panel with a control knob according to one embodiment of the invention, with the control panel shown in the environment of a cook stove.
Figure 2:
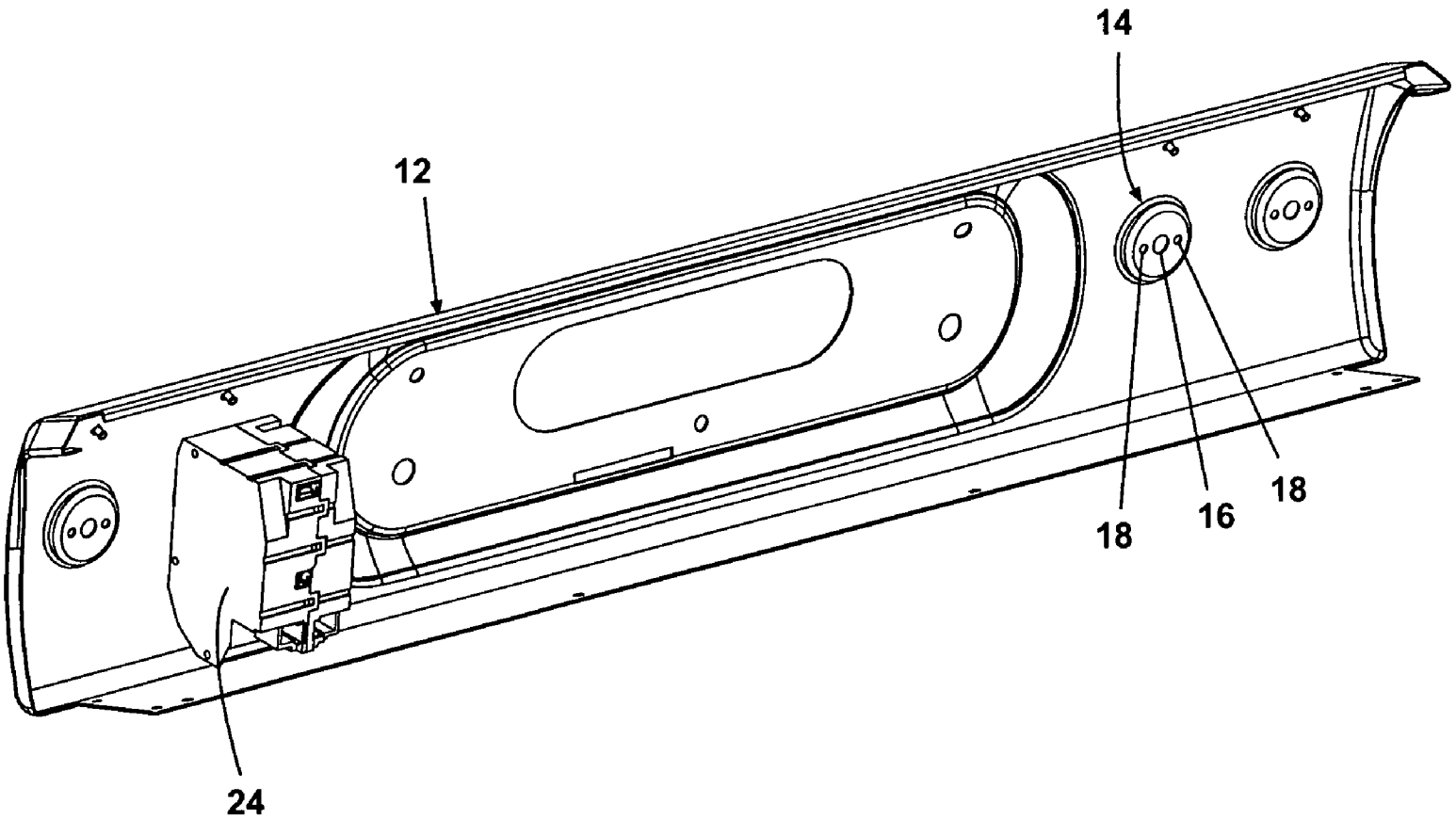
FIG. 2 is a perspective view of the reverse face of the control panel illustrated in FIG. 1 and showing a portion of a push and turn control device.

Referring to FIG. 1, an embodiment of the invention is illustrated in the form of a control knob assembly 10 in cooperative registry with a control panel 12 such as can be found on a generally well known household cooking appliance 11. The control knob assembly 10 and control panel can be used on other devices, including other appliances, such as a dishwasher, a clothes washer or dryer, and the like. The panel 12 has a plurality of knob recesses 14 having a circular recess face 22 spaced inwardly away from a panel face 20. A stem aperture 16 extends through the recess face 22. One or more mounting apertures 18 extend through the recess face 22 for mounting of a control device, such as a gas burner control, or an electric switch assembly, to the panel 12. FIG. 2 illustrates a switch assembly 24 mounted to the panel 12 in such a fashion.

Figure 3:
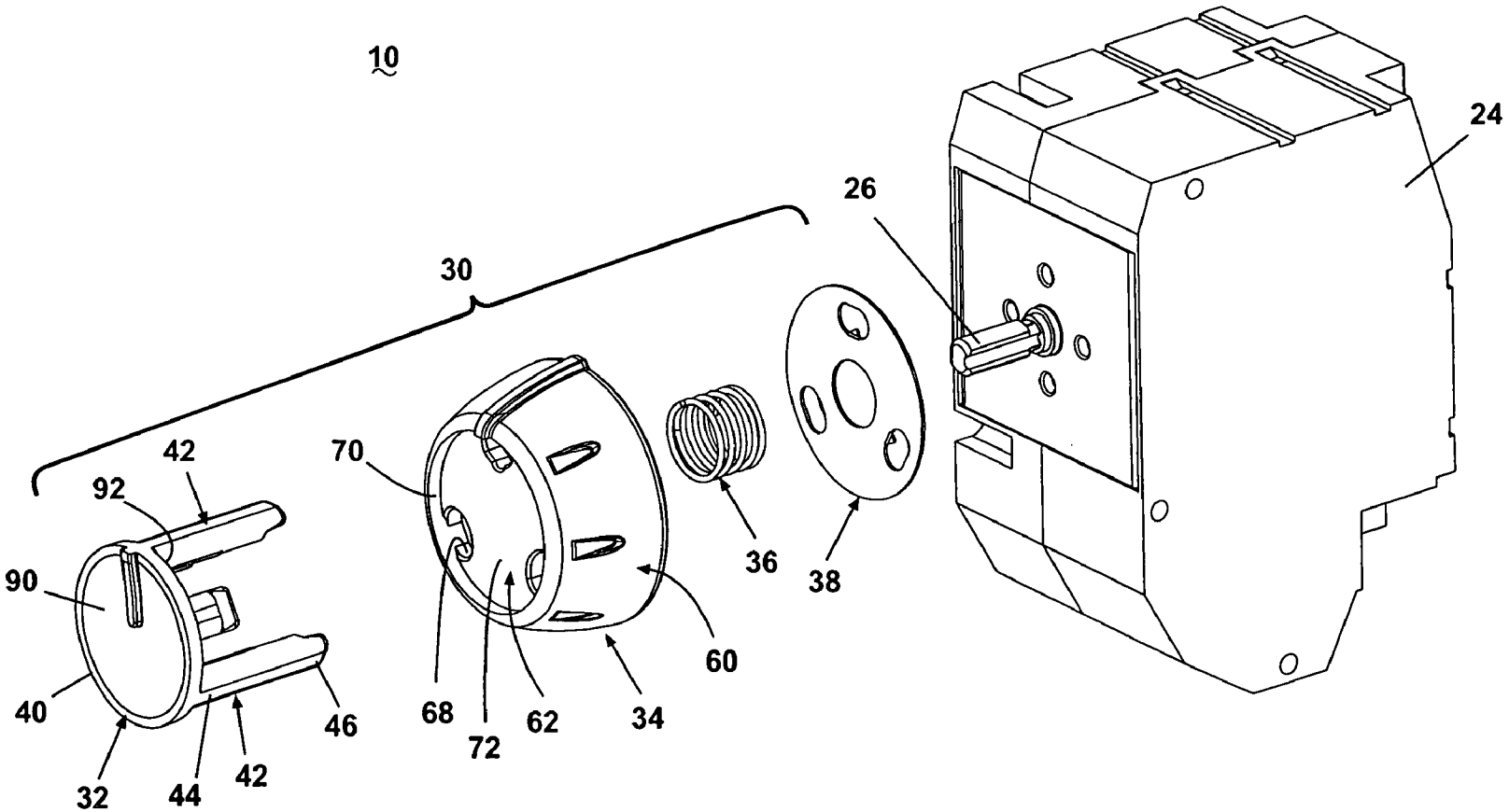
FIG. 3 is an exploded view of the control knob assembly illustrated in FIG. 1 in relation to the push and turn control device.

As illustrated in FIG. 3, the control knob assembly 10 has a knob 30 adapted for attachment to the switch assembly 24. The switch assembly 24 has a stem 26 which can be operated by depressing and rotating the stem 26. The knob 30 has a cap 32, a skirt 34, a spring 36, and a retainer 38.

The stool-shaped cap 32 has a disc 40 with an obverse face 90 and a reverse face 92. A plurality of legs 42, illustrated in FIG. 3 as numbering three, extends generally orthogonally away from the reverse face 92. Preferably, the legs 42 are evenly spaced along the periphery of the disc 40.

Figure 4:
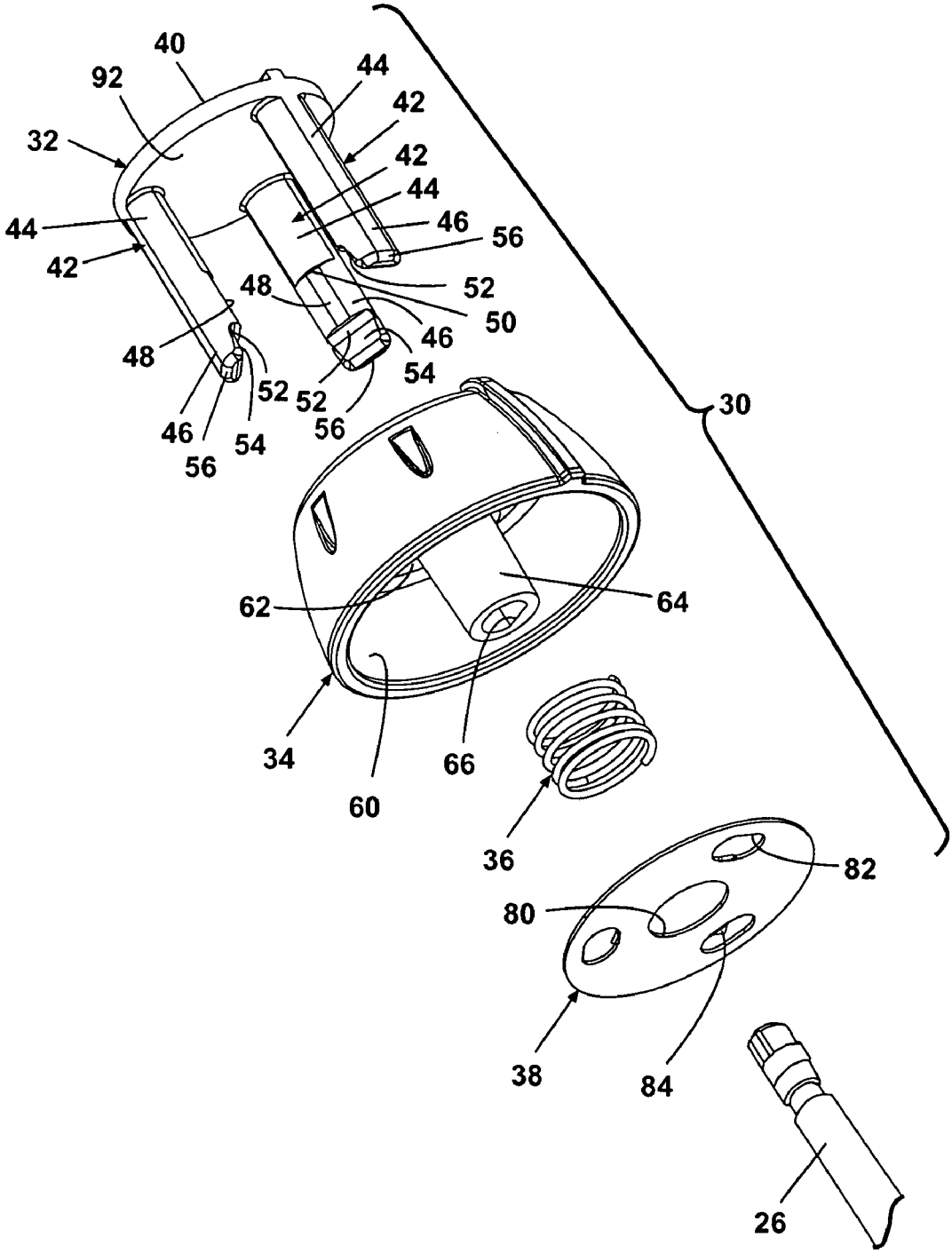
FIG. 4 is an enlarged and reversed exploded view of the control knob illustrated in FIG. 3 in relation to a portion of the push and turn control device.

Referring to FIG. 4, the legs 42 are elongated, generally cylindrical members having a cylindrical proximal portion 44 attached to the reverse face 92 of the disc 40 and a distal portion 46. The somewhat cylindrical distal portion 46 has a channelway 48 extending longitudinally along a radially inwardly directed side thereof. The channelway 48 terminates at the proximal portion 44 in an end wall 50. A somewhat semicircular finger 54 extends distally away from the distal portion 46 to terminate in a tip 56. A shoulder 52 defines the transition of the channelway 48 to the finger 54.

Referring again to FIG. 3, the skirt 34 has a hollow, somewhat rounded frustoconical form. A perimeter wall 60 terminates at one end in an end wall 62 having an obverse face 72 and a plurality of regularly spaced openings 68 extending therethrough for cooperative registry with the legs 42, as hereinafter described. The perimeter wall 60 extends beyond the obverse face 72 to form a circular rim 70. The diameter of the rim 70 permits nesting of the disc 40 within the rim 70 with the reverse face 92 of the disc 40 in contact with the obverse face 72.

As illustrated in FIG. 4, a generally cylindrical, elongated collar 64 having a bore 66 adapted for slidable, frictional registry with the stem 26 extends longitudinally away from the end wall 62 coaxial with the perimeter wall 60.

The helical spring 36 has a diameter adapted for slidable receipt over the collar 64, with a spring constant suitable for the purposes described herein.

The circular, plate-like retainer 38 has a stem aperture 80 extending coaxially therethrough adapted for slidable registry with the collar 64. The diameter of the retainer 38 permits the coaxial nesting of the retainer 38 within of the perimeter wall 60. A plurality of openings 82 are regularly spaced around the retainer 38 for cooperative disposition with the openings 68 in the end wall 62 and the legs 42. A tooth 84 extends radially outwardly from an inner edge of each opening 82.

Figure 5:
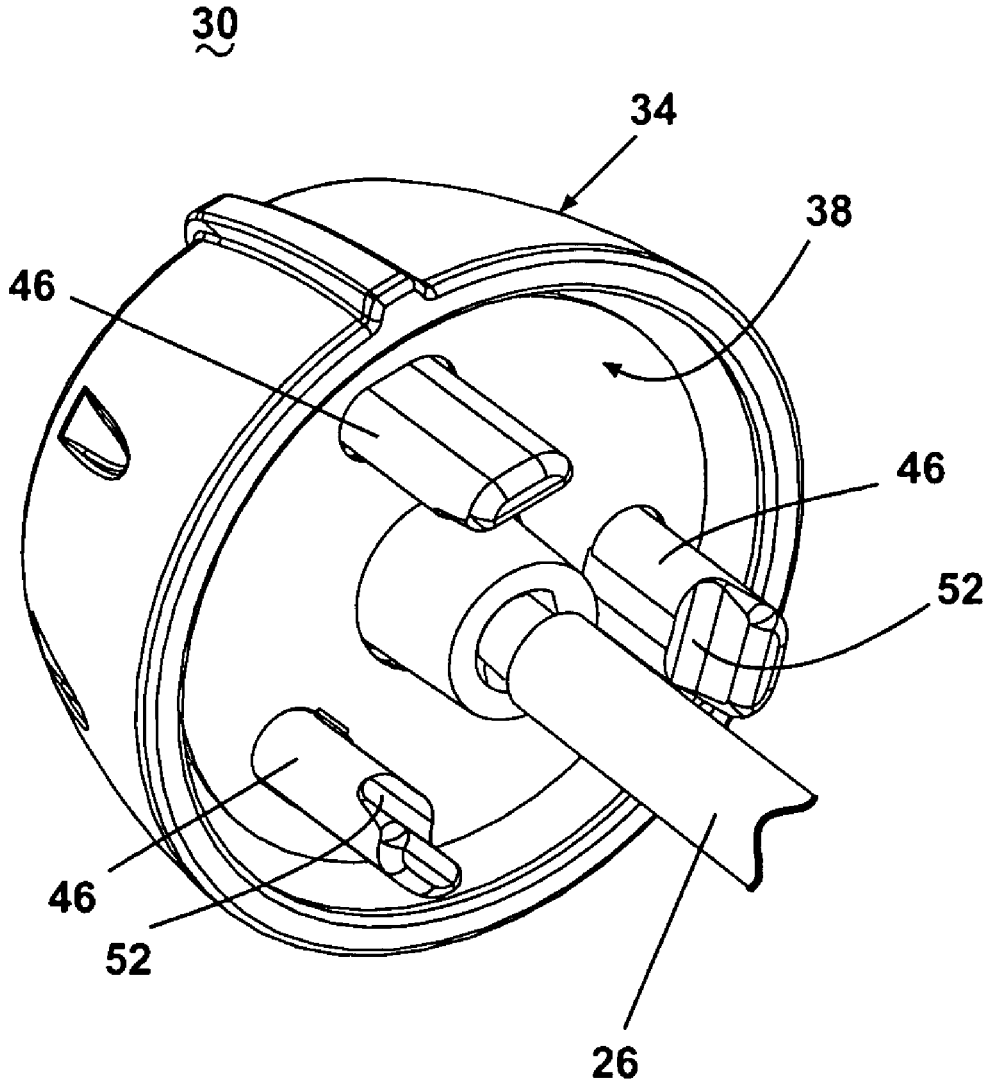
FIG. 5 is an enlarged perspective view of the control knob illustrated in FIG. 4 in an assembled configuration and attached to the push and turn control device. The panel is removed for clarity.

Referring to FIG. 5, assembly of the knob 30 includes inserting the legs 42 through the openings 68, installing the spring 36 over the collar 64, and sliding the retainer 38 over the collar 64 and the legs 42 to sandwich the spring 36 between the end wall 62 and the retainer 38. The configuration of the openings 82 in the retainer 38 permits the distal portion 46 of the legs 42 to be slidably received in the openings 82. The retainer 38 engages the end walls 50 of the legs 42, with the teeth 84 engaging the channelway 48 to retain the retainer 38 on the legs 42.

When the switch assembly 24 has been mounted to the panel 12, the knob 30 can be inserted onto the stem 26 for operation of the switch assembly 24. The knob 30 can be slidably removed from the stem 26 for cleaning and replacement.

Figure 6:
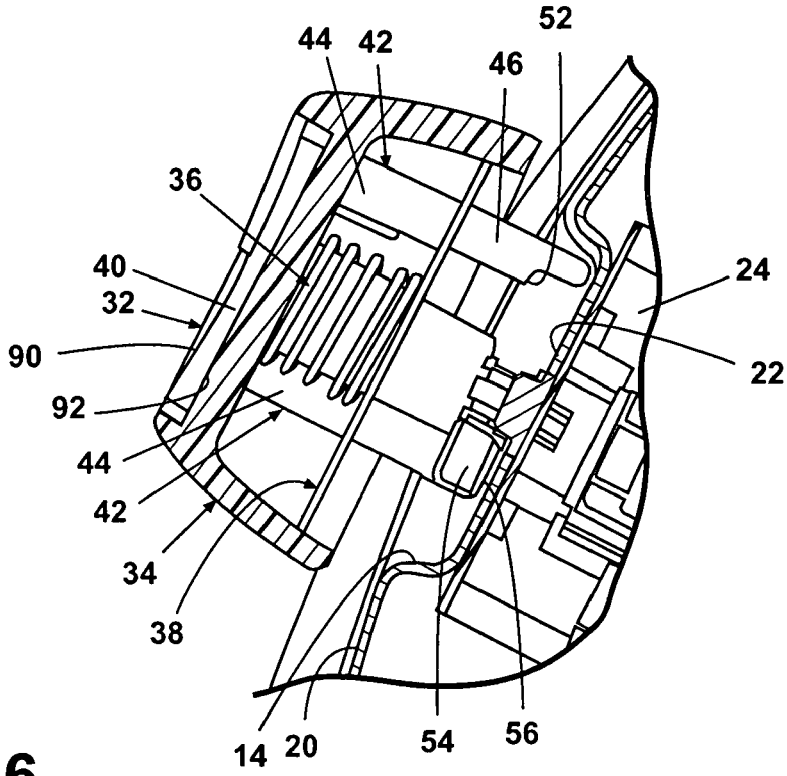
FIG. 6 is a partial cutaway view of the interior of the control knob of FIG. 1 illustrating the control knob in a rest position.

Referring now to FIG. 6, installation of the knob 30 to the control panel 12 and the switch assembly 24 includes inserting the stem 26 into the bore 66 so that the legs 42 extend into the recess 14 with the tips 56 just touching the recess face 22. It will be evident that the cap 32 cannot be depressed toward the panel 12 due to the contact of the tips 56 with the recess face 22. The skirt 34 can slide along the legs 42 and, thus, can be urged toward the panel 12. The retainer 38 is fixed relative to the cap 32. The spring 36 bears against the retainer 38 to urge the skirt 44 away from the panel 12. Urging the skirt 34 toward the panel 12 will compress the spring 36 against the retainer 38. The spring 36 will bias the skirt 34 away from the panel in the absence of an operator grasping and urging the skirt 34 toward the panel 12.

Figure 7:
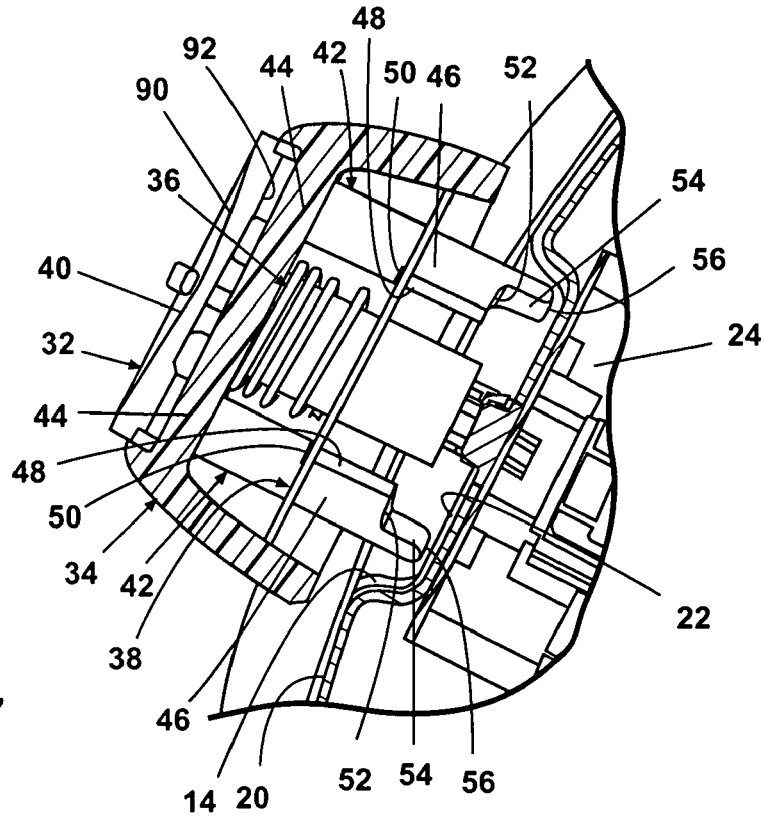
FIG. 7 is a partial cutaway view of the interior of the control knob of FIG. 1 illustrating the control knob in an operating position.

As illustrated in FIG. 7, grasping and depressing the skirt 34 toward the panel 12 will depress the stem 26, enabling the skirt 34 to be rotated in accordance with the normal operation of the switch assembly 24. The rotation of the skirt 34 will also rotate the cap 32, urging the tips 56 to slidably translate along the recess face 22. The cap 32 cannot be depressed and, thus, the switch assembly 24 cannot be operated by pushing against the cap 32. The cap 32 prevents the depression of the stem 26 and the inadvertent operation of the switch assembly 24.

The control knob provides a means of operating a push and turn control device which is highly effective at preventing inadvertent depression and rotation of the control stem for the device. The control knob is simple in design and operation. The cap prevents inadvertent depression of the control knob due to the engagement of the legs of the cap with the control panel. Furthermore, the cap is axially isolated from the stem of the control device. The sliding skirt is axially isolated from the cap and can be depressed independently of the cap to depress the control stem and operate the control device. However, the cap and skirt are rotationally coupled so that, once the control stem is depressed, the cap and skirt can be integrally rotated. Depression of the skirt requires grasping the skirt about its perimeter, requiring a specific hand manipulation which will minimize its operation by small children. An impact on the top of the control knob will not result in the depression of the stem as the brunt of the impact will be on the cap, which is not capable of axial movement.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A control panel assembly comprising:

a panel;

a push-and-turn switch assembly mounted to the panel and having a stem axially movable and rotatable to effect actuation of the switch assembly;

a control knob comprising a cap and a skirt, the cap is axially immobile relative to the stem, the skirt comprising an end wall having a depending collar in which a portion of the stem is slidably received to mount the skirt to the stem for axial movement therewith, and the skirt is axially moveable relative to the cap, whereby an axial force acting on the cap is not transferred to the stem and an axial force acting on the skirt will cause axial movement of the stem.

2. The control panel assembly according to claim 1 wherein the cap is operably coupled with the skirt such that the skirt and the cap rotate together.

3. The control panel assembly according to claim 1 wherein the skirt is axially moveable between a first position, where the stem is not free to rotate, and a second position, where the stem is free to rotate.

4. The control panel assembly according to claim 1 wherein the cap comprises a portion in abutting relationship with the panel to axially immobilize the cap.

5. The control panel assembly according to claim 1 wherein the cap comprises a disc from which depends at least one leg, with the disc overlying the end wall of the skirt and the at least one leg extending through an opening in the end wall and in abutting relationship with the panel.

6. The control panel assembly according to claim 5, and further comprising a spring operably coupled to the skirt to bias the end wall of the skirt against the disc of the cap.

7. The control panel assembly according to claim 6, and further comprising a retainer mounted to the at least one leg, and the spring extends between the end wall and the retainer.

8. A control panel assembly comprising:

a panel;

a push-and-turn switch assembly mounted to the panel and having a stem axially movable and rotatable to effect actuation of the switch assembly;

a control knob comprising a cap and a skirt, the cap is axially immobile relative to the stem, the skirt is coupled to the stem for axial movement therewith, and the skirt is axially moveable relative to the cap, the skirt axially moveable between a first position, where the stem is not free to rotate, and a second position, where the stem is free to rotate, and whereby an axial force acting on the cap is not transferred to the stem and an axial force acting on the skirt will cause axial movement of the stem; and a biasing device to bias the skirt into the first position.

9. A control knob for a control panel assembly having a panel to which a push-and-turn switch assembly is mounted, with the switch assembly having a stem axially movable and rotatable to effect actuation of the switch assembly, the control knob comprising a cap and a skirt, the cap is axially immobile relative to the stem, the skirt comprising an end wall having a depending collar, a portion of which is adapted to slidably receive the stem for mounting the skirt to the stem for axial movement therewith, and the skirt is axially moveable relative to the cap, whereby an axial force acting on the cap is not transferred to the stem and an axial force acting on the skirt will cause axial movement of the stem.

10. The control knob according to claim 9 wherein the cap is operably coupled with the skirt such that the skirt and the cap rotate together.

11. The control knob according to claim 9 wherein the skirt is axially moveable between a first position, where the stem is not free to rotate, and a second position, where the stem is free to rotate.

12. The control knob according to claim 9 wherein the cap comprises a portion adapted for abutting relationship with the panel for axial immobilization of the cap.

13. The control knob according to claim 9 wherein the cap comprises a disc from which depends at least one leg, with the disc overlying the end wall of the skirt and the at least one leg extending through an opening in the end wall and adapted for abutting relationship with the panel.

14. The control knob according to claim 13, and further comprising a spring operably coupled to the skirt to bias the end wall of the skirt against the disc of the cap.

15. The control knob according to claim 14, and further comprising a retainer mounted to the at least one leg, and the spring extends between the end wall and the retainer.

16. A control knob for a control panel assembly having a panel to which a push-and-turn switch assembly is mounted, with the switch assembly having a stem axially movable and rotatable to effect actuation of the switch assembly, the control knob comprising:

a cap and a skirt, the cap is axially immobile relative to the stem, the skirt is coupled with the stem for axial movement therewith, and the skirt is axially moveable relative to the cap, the skirt axially moveable between a first position, where the stem is not free to rotate, and a second position, where the stem is free to rotate, and whereby an axial force acting on the cap is not transferred to the stem and an axial force acting on the skirt will cause axial movement of the stem; and a biasing device to bias the skirt into the first position.

* * * * *